US010753076B2

(12) United States Patent
Kashirajima et al.

(10) Patent No.: US 10,753,076 B2
(45) Date of Patent: Aug. 25, 2020

(54) FLUSH TOILET

(71) Applicant: TOTO LTD., Kitakyushu-shi, Fukuoka (JP)

(72) Inventors: Shu Kashirajima, Kitakyushu (JP); Makoto Bekki, Kitakyushu (JP); Hironori Yamasaki, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 16/112,357

(22) Filed: Aug. 24, 2018

(65) Prior Publication Data

US 2019/0078307 A1 Mar. 14, 2019

(30) Foreign Application Priority Data

Sep. 8, 2017 (JP) ..... 2017-173101

(51) Int. Cl.
*E03D 11/08* (2006.01)

(52) U.S. Cl.
CPC ..... *E03D 11/08* (2013.01)

(58) Field of Classification Search
CPC . E03D 11/08; E03D 2201/20; E03D 2201/30; E03D 2201/40; E03D 9/08; B05B 1/3405; B05B 1/341; B05B 1/3421–3457
See application file for complete search history.

(56) References Cited

U.S. PATENT DOCUMENTS 5,529,084 A * 6/1996 Mutsakis ..... F15D 1/04 137/13
6,986,172 B2 1/2006 Hidetaka et al.
7,661,153 B2 2/2010 Nakamura et al.
9,079,203 B2 * 7/2015 Cheng ..... B05B 1/3415
(Continued)

FOREIGN PATENT DOCUMENTS

CN 1432094 A 7/2003
CN 100430562 C 11/2008
(Continued)

OTHER PUBLICATIONS

An Office Action mailed by the Japanese Patent Office dated Aug. 13, 2019, which corresponds to Japanese Patent Application No. 2017-173101 and is related to U.S. Appl. No. 16/112,357; with English language translation.
(Continued)

*Primary Examiner* — David P Angwin
*Assistant Examiner* — Nicholas A Ros
(74) *Attorney, Agent, or Firm* — Studebaker & Brackett PC

(57) ABSTRACT

Problem: To provide a flush toilet wherein anomalous sounds can be suppressed from occurring when flush water is spouted from the rim spout port together with air accumulated in the upper portion within the rim conduit, and quietness can be improved.

Solution: The flush toilet of the present invention includes: a bowl portion 20 having a bowl-shaped waste receiving surface 14 and a rim portion 18 formed on a top edge of a waste receiving surface; a rim spout port 26 configured to spout flush water from the rim portion onto the bowl portion; a rim conduit 24 disposed in the rim portion extending from a rear side region of the bowl portion to the rim spout port; and a stirring portion 44 configured to agitate flush water which is supplied into the rim conduit 24.

8 Claims, 10 Drawing Sheets

(56) References Cited

U.S. PATENT DOCUMENTS

| | | | | |
|---|---|---|---|---|
| 9,656,282 | B2 * | 5/2017 | Lehmann | B05B 1/341 |
| 2003/0088910 | A1 | 5/2003 | Hidetaka et al. | |
| 2006/0005310 | A1 | 1/2006 | Nakamura et al. | |

FOREIGN PATENT DOCUMENTS

| | | | | | |
|---|---|---|---|---|---|
| GB | 452338 | | * | 8/1936 | E03D 11/08 |
| JP | 2008-303616 | A | | 12/2008 | |
| JP | 2008303616 | | * | 12/2008 | E03D 11/08 |
| JP | 2010138693 | A | | 6/2010 | |
| JP | 2016084596 | A | | 5/2016 | |
| JP | 2017-020212 | A | | 1/2017 | |
| JP | 2017-040132 | A | | 2/2017 | |
| WO | WO2017056709 | | * | 4/2017 | E03D 11/13 |

OTHER PUBLICATIONS

An Office Action issued by the State Intellectual Property Office of the People's Republic of China dated Mar. 5, 2020, which corresponds to Chinese Patent Application No. CN201811001324.1.

* cited by examiner

FLUSH TOILET

TECHNICAL FIELD

The present invention relates to a flush toilet, and more particularly to a flush toilet flushed by flush water supplied from a flush water source to discharge waste.

BACKGROUND ART

In a conventional flush toilet, it has been known, as set forth in Patent Document 1 (JP 2008-303616A), that anomalous sounds such as an air explosion sound or air mixing sound are generated by the emergence of air together with flush water in the rim conduit from a rim spout port when water is spouted from a rim spout port in a flush toilet.

SUMMARY OF THE INVENTION

Technical Problem

In the conventional flush toilet set forth in the above-described Patent Document 1, consideration has been given to positioning the rim spout port on the rim portion in the front side region being the front side of half of the waste receiving surface, in order to reduce visibility of the rim spout port to users and improve design characteristics of a flush toilet, and to improve flushing characteristics of the waste receiving surface.

However, disposing a rim spout port on the front side region of the waste receiving surface lengthens the rim conduit, as the rim conduit must be formed from the rear side region to the front side region. This then leads to the problem that the amount of air inside the rim conduit is increased, and then flush water is discharged together with air when flush water is spouted, and air-induced anomalous sounds are more likely to occur.

The present invention has been made to solve the above conventional problem, the occurrence of anomalous sounds can be suppressed when flush water is spouted from the rim spout port together with air accumulated in the upper portion within the rim conduit, and silence of the flush toilet can be improved

Solution to Problem

To achieve the above-described object, the present invention is a flush toilet flushed by flush water supplied from a flush water source to discharge waste, comprising: a bowl portion including a bowl-shaped waste receiving surface and a rim portion formed on the top edge of the waste receiving surface; a rim spout port for spouting flush water from the rim portion into the bowl portion; a rim spout port configured to spout flush water from the rim portion onto the bowl portion; a rim conduit disposed within the rim portion extending from a rear side region of the bowl portion to the rim spout port; and a stirring portion for agitating flush water supplied into the rim conduit.

In the invention thus constituted, flush water supplied into the rim conduit is agitated by the stirring portion, and air accumulated in the upper portion within the rim conduit can be stirred by the agitated flush water. Air in the rim conduit is thus finely divided within the rim conduit and spouted from the rim spout port together with flush water. Thus by using the present invention, the occurrence of anomalous sounds can be suppressed from occurring when flush water is spouted from the rim spout port together with air accumulated in the upper portion within the rim conduit, and silence of the flush toilet can be improved.

In the present invention, preferably, the stirring portion comprise a stationary drive portion configured to impart a rotational force to a flow of flush water, the rotational force being formed about an axis in a flow direction of flush water.

In the invention thus constituted, a rotational force with an axis in the direction of flow of flush water supplied into the rim conduit is imparted by the stationary drive portion to a flow of flush water. The flow of flush water is thus agitated, and the air accumulated at the upper portion within the rim conduit can be stirred by the agitated flush water.

In the present invention, preferably, the stirring portion is disposed on the inlet portion of the rim conduit.

In the invention thus constituted, the stirring portion is disposed on the inlet of the rim conduit, therefore flush water supplied into the rim conduit is agitated from the inlet portion of the rim conduit, and air accumulated in the upper portion inside the rim conduit can be efficiently stirred by the agitated flush water.

In the present invention, preferably, the rim conduit has a conduit with a height higher than the height of the opening of the rim spout port.

In the invention thus constituted, in rim conduits in which anomalous sounds caused by air accumulated in the upper portion within the rim conduit can easily occur, such as the rim conduit having a conduit with a height higher than the height of the opening of the rim spout port, flush water supplied into the rim conduit is agitated by a stirring portion. The air accumulated at the upper portion within the rim conduit can in this way be stirred by the agitated flush water.

In the present invention, preferably, the rim spout port is formed on the rim portion in the front side region of the bowl portion.

In the invention thus constituted, in rim conduits in which anomalous sounds caused by air accumulated in the upper portion within the rim conduit can easily occur, such as the rim conduit extending from the rear side region of the bowl portion up to a rim spout port formed in the front side region, flush water supplied into the rim conduit is agitated by a stirring portion. The air accumulated at the upper portion within the rim conduit can in this way be stirred by the agitated flush water.

The present invention preferably further comprises a nozzle for supplying flush water into the rim conduit, and the stirring portion is a rib protruding into a conduit of the nozzle at the tip portion of the nozzle.

In the invention thus constituted, flush water supplied into the rim conduit is agitated by the ribs protruding into the water passageway of the nozzle at the tip portion of the nozzle, and air accumulated in the upper portion within the rim conduit can be stirred by the agitated flush water.

In the present invention, preferably, the rim conduit comprises an outer portion extending in the interior of the rim portion toward a front, a curved portion curving from the downstream end of the outside portion to an inside, and an inside portion extending from the curved portion toward a rear; wherein the rim spout port is formed at the downstream end of the inner portion, and spouts flush water rearward.

In the invention thus constituted, the rim conduit comprises an inside portion extending rearward through the curved portion from an outer portion extending to the front inside the rim portion, and extends to the rim spout port for spouting flush water rearward. Therefore by using the present invention, the volume of the rim conduit can be reduced compared to the case in which the rim conduit extends through the interior of the rim portion at the front end of the bowl portion. Thus in the present invention the amount of air accumulating in the upper portion inside the rim conduit can be reduced, and the occurrence of air-induced anomalous sounds can be still further suppressed.

In the present invention, preferably, the rim conduit is formed so that in an upstream portion of the rim conduit, a cross sectional area of a lower half of the upstream portion is smaller than the cross sectional area of an upper half of the upstream portion.

In the invention thus constituted, flush water supplied into the rim conduit flows more easily into the upper portion within the rim conduit, and air accumulated in the upper portion within the rim conduit can be more easily stirred by agitated flush water. Air in the rim conduit is thus finely divided within the rim conduit and spouted from the rim spout port together with flush water. Thus by using the present invention, the occurrence of anomalous sounds can be further suppressed when flush water is spouted from the rim spout port together with air accumulated in the upper portion within the rim conduit, and silence can be further improved.

In the present invention, preferably, the rim conduit has a guide portion for guiding upwardly flush water supplied into the rim conduit.

In the invention thus constituted, flush water supplied into the rim conduit by the guide portion can be made to more easily flow into the upper portion within the rim conduit, and air accumulated in the upper portion within the rim conduit can be more easily stirred by agitated flush water. Thus by using the present invention, the occurrence of anomalous sounds can be further suppressed when flush water is spouted from the rim spout port together with air accumulated in the upper portion within the rim conduit, and silence of the flush toilet can be further improved.

In the present invention, preferably, the rim conduit has a cross sectional shape in the vertical direction, the cross sectional shape is formed by a combination of a vertically-oriented long hole and a horizontally-oriented long hole.

In the invention thus constituted, because vertically-oriented long holes extend in the upper half of the rim conduit, a rim conduit can be easily formed in which the cross sectional area of the lower half of the rim conduit is smaller than the cross sectional area of the upper half thereof. Therefore flush water supplied into the rim conduit can be made to more easily flow into the upper portion within the rim conduit, and air accumulated in the upper portion within the rim conduit can be more easily stirred by agitated flush water.

Advantageous Effects of Invention

Thus in a flush toilet of the present invention, anomalous sounds can be suppressed from occurring when flush water is spouted from the rim spout port together with air accumulated in the upper portion within the rim conduit, and silence can be improved.

DESCRIPTION OF EMBODIMENTS

Figure 1:
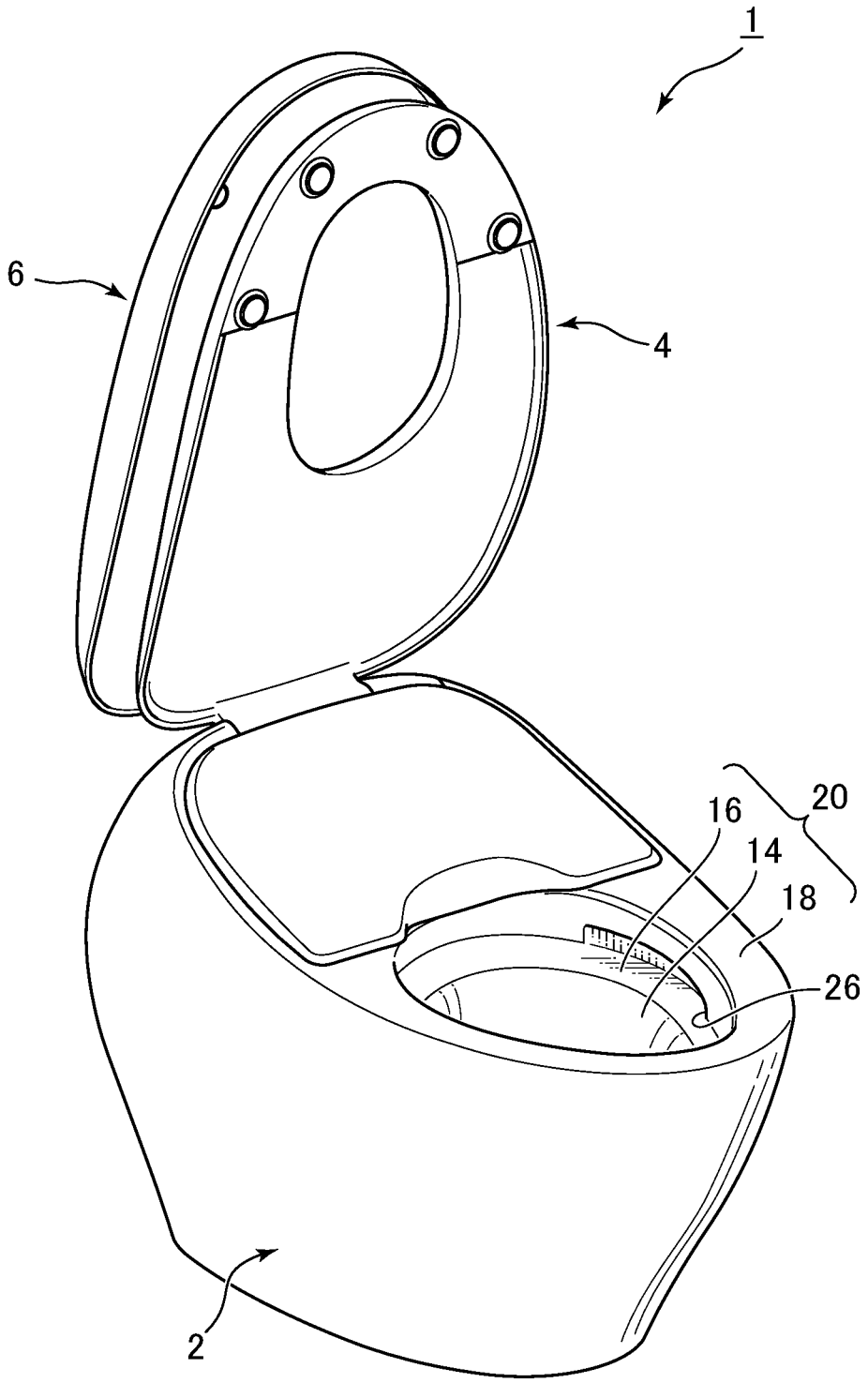
FIG. 1 is a perspective view showing the state wherein in a flush toilet according to an embodiment of the invention, the toilet lid and toilet seat are rotated to an up position.
Figure 2:
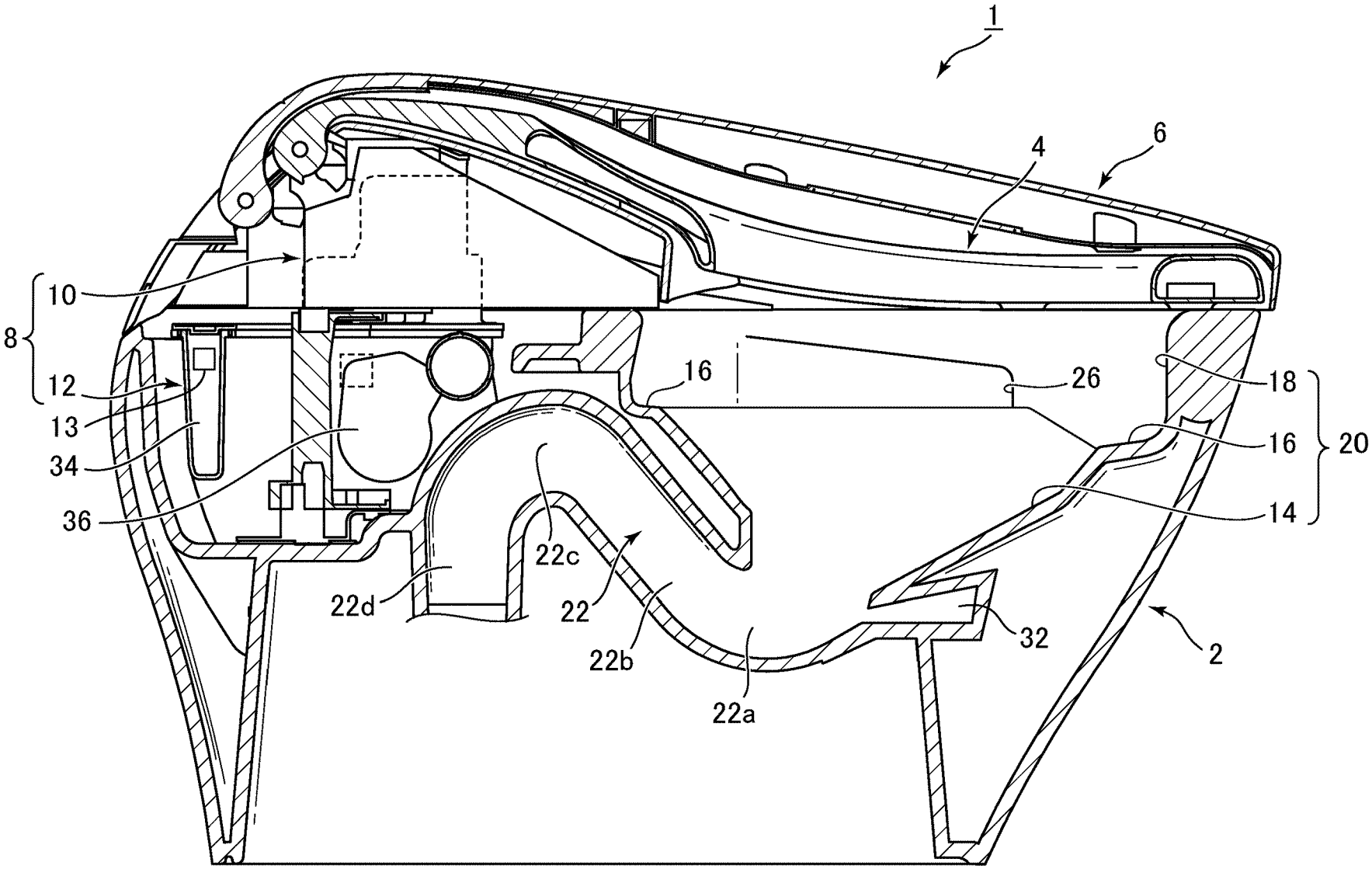
FIG. 2 is a cross section wherein in a flush toilet according to an embodiment of the invention, a center cross section in the left-right direction of the toilet is seen from the left side, with the toilet lid and toilet seat rotated to a down position.
Figure 3:
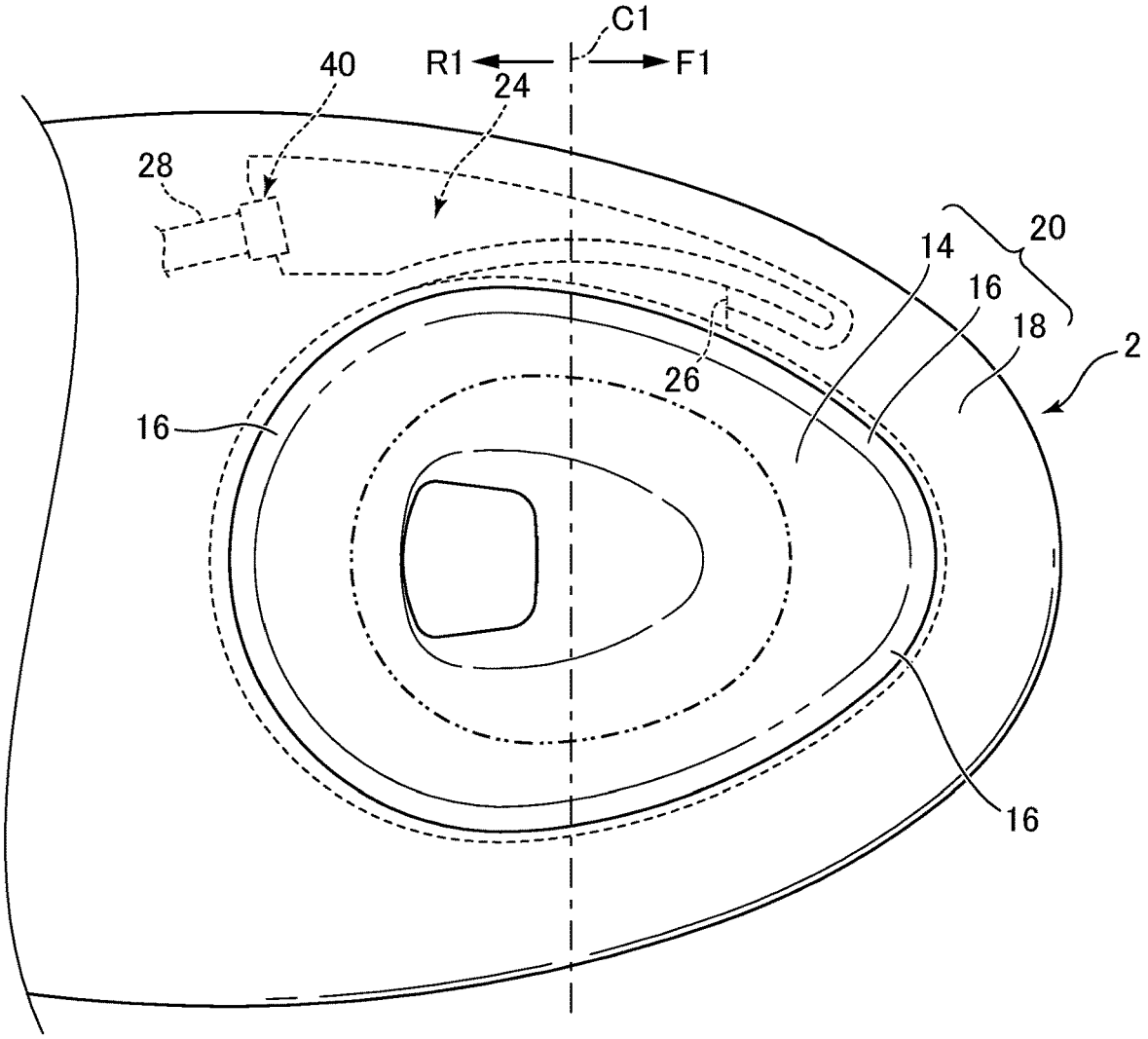
FIG. 3 is a partial plan view showing the flush toilet main body part of a flush toilet according to the embodiment of the invention shown in FIG. 1.

Next, referring to FIGS. 1-3, we explain a flush toilet according to an embodiment of the invention. FIG. 1 is a perspective view showing the state whereby in a flush toilet according to an embodiment of the invention, the toilet lid and toilet seat are rotated to an up position. FIG. 2 is a cross section whereby in a flush toilet according to an embodiment of the invention, a center cross section in the left-right direction of the toilet is seen from the left side, with the toilet lid and toilet seat rotated to a down position. FIG. 3 is a partial plan view showing the flush toilet main body part of a flush toilet according to the embodiment of the invention shown in FIG. 1.

Below, in an explanation of an embodiment of the present invention, we discuss the near side as seen from the user's side when using a flush toilet 1 (the user's side when standing in front of the flush toilet 1 to use the flush toilet 1) as the front side, the side in the back as seen by a user as the rear side, the side on the right as seen from the front by a user using the flush toilet 1 as the right side, and side on the left as seen from the front as the left side.

As shown in FIGS. 1-3, a flush toilet 1 according to an embodiment of the invention comprises: a toilet main body 2, a toilet seat 4 disposed to be rotatable up and down on the top surface of the toilet main body 2, a toilet lid 6 disposed to be rotatable up and down to cover the toilet seat 4, and a functional portion 8 disposed at the rear of the toilet main body 2.

As shown in FIG. 2, a functional portion 8 comprises a hygienic washing system functional portion 10 serving as a hygienic washing portion for washing a user's groin region, and a water supply system functional portion 12 involved in the function of supplying water to the toilet main body 2.

The toilet main body 2 comprises a bowl-shaped waste receiving surface 14, and a rim portion 18 formed to rise from a shelf surface 16 on the top edge of this waste receiving surface 14. Also, the toilet main body 2 comprises a bowl portion 20. The bowl portion 20 comprises a discharge trap pipe 22 serving as a discharge path for discharging waste in the bowl portion 20, the inlet portion 22*a* of the discharge trap pipe 22 is connected to the bottom of the bowl portion 20.

A jet spout portion 32 is formed at the bottom portion of the bowl portion 20 so as to point toward the inlet portion 22*a* of the discharge trap pipe 22. Regarding water spouted (jet spouted) by this jet spout portion 32, flush water accumulated in a reservoir tank 34 disposed on the water supply system functional portion 12 is pressurized by a pressurizing pump 36 in the water supply system functional portion 12 and jetted from the jet spout portion 32.

The specific structures of the hygienic washing system functional portion 10 and the water supply system functional portion 12 are respectively the same as conventional functional portions, hence details thereof are here omitted. Note also that a controller 13 or the like for controlling the opening and closing operation of an electromagnetic valve, the switchover operation of a switching valve, and the rpm and operating time, etc. of the pressurizing pump is disposed on the water supply system functional portion 12.

A flush toilet 1 according to the present embodiment is a hybrid flush toilet, wherein rim spouting by the rim spout port 26 is performed utilizing municipal utility supply pressure, and jet spouting by the jet spout portion 32 is accomplished by supplying flush water from the reservoir tank 34 by controlling the pressurizing pump 36. In the flush toilet, flush water supplied from the municipal utility may be switched by switching a valve between rim spouting by the rim spout port 26 and jet spouting by the jet spout portion 32. Also, flush water supplied from the reservoir tank in the flush toilet may be switched between rim spouting by the rim spout port 26 and jet spouting by the jet spout portion 32.

Next, referring to FIGS. 3 through 10, we explain details of the rim water passageway 24 and rim spout port 26 in a flush toilet 1 according to an embodiment of the invention.

Figure 4:
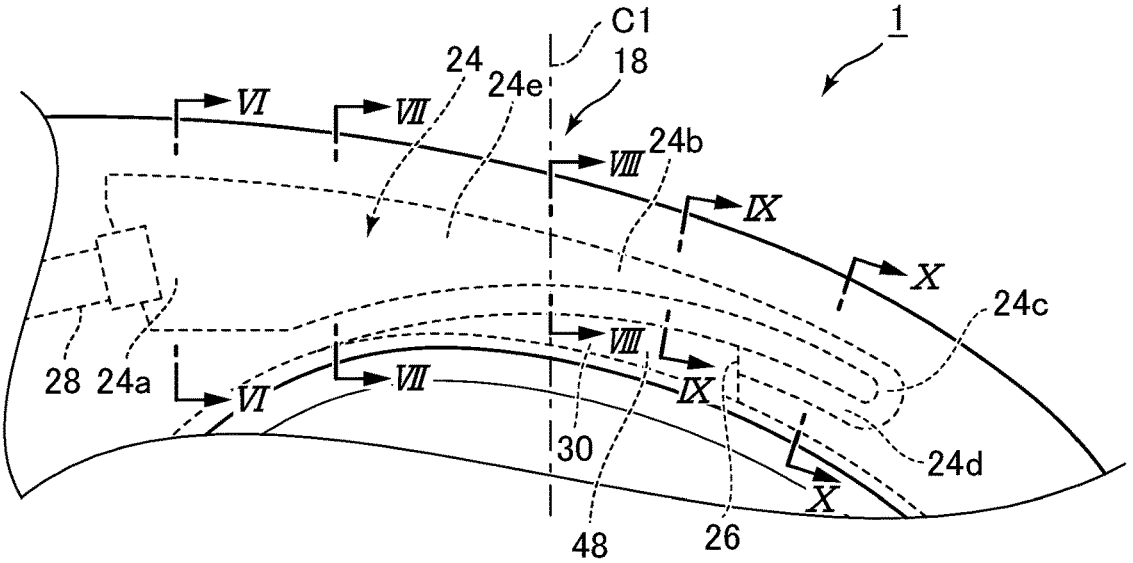
FIG. 4 is a partial expanded plan view of the part of the rim conduit formed on the interior of a rim portion in the toilet main body part of a flush toilet according to the embodiment of the invention shown in FIG. 3.
Figure 5:
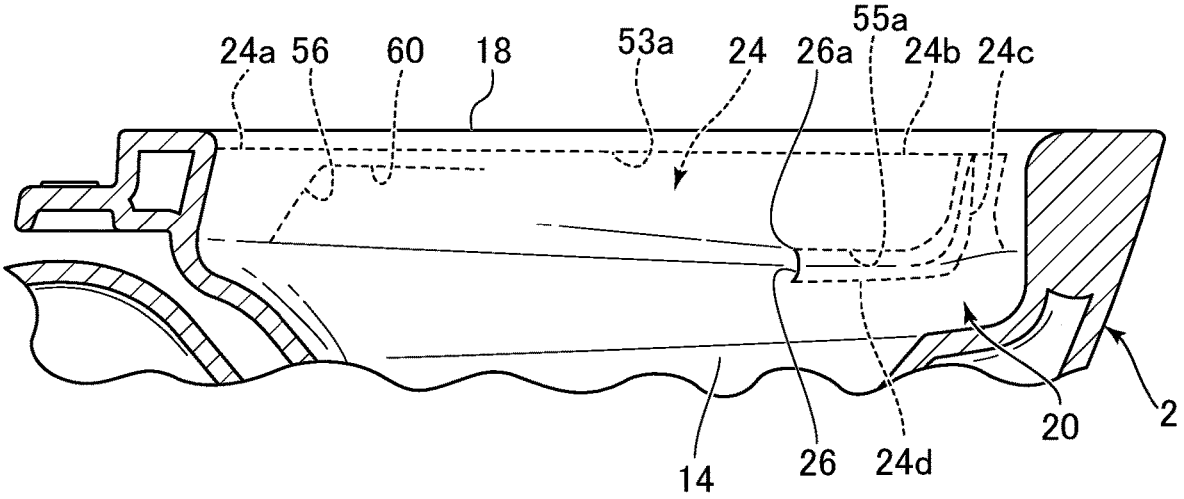
FIG. 5 is a partial expanded side view showing the part of the rim conduit formed on the interior of a rim portion in a cross sectional view of a flush toilet according to the embodiment of the invention shown in FIG. 2.

FIG. 4 is a partial expanded plan view of the part of the rim conduit formed on the interior of a rim portion in the toilet main body part of a flush toilet according to the embodiment of the invention shown in FIG. 3. FIG. 5 is a partial expanded side view showing the part of the rim conduit formed on the interior of a rim portion in a cross sectional view of a flush toilet according to the embodiment of the invention shown in FIG. 2.

As shown in FIGS. 3 and 4, the toilet main body 2 comprises a rim spout port 26 for spouting flush water from the rim portion 18 into the bowl portion 20, and a rim conduit 24 extending from the rear side region of the bowl portion 20 in the rim portion 18 to the rim spout port 26.

A water conducting pipe 28 is attached to the inlet portion 24*a* at the upstream end of the rim conduit 24. The water conducting pipe 28 supplies flush water supplied into the rim conduit 24 from a municipal utility (not shown) serving as a flush water source. This water conducting pipe 28 is directly connected to a municipal utility (not shown) serving as a flush water source. By utilizing the municipal utility supply pressure, flush water supplied from the water conducting pipe 28 into the rim conduit 24 is directed forward within the rim conduit 24, after which is directed to make a U-turn in the rim portion 18 toward the rear side, then guided to the rim spout port 26.

As shown in FIG. 3, the bowl 20 comprises a front side region F1 being front side of, and a rear side region R1 being the rear side of, a center line C1 extending in the left-right direction and dividing the bowl portion 20 into two equal parts in the front-rear direction. A rim water passageway 24 extends from the rear side region R1 to the front side region F1 in the rim portion 18 on either the left or the right side of this bowl portion 20.

The rim spout port 26 is formed on the inside circumferential surface of the rim portion 18 in the front side region F1 of the bowl portion 20. The rim spout port 26 spouts flush water toward the rear. A circulating flow is formed in the bowl portion 20 by the circling of flush water spouted from the rim spout port 26 within the bowl portion 20. The rim spout port 26 forms a single spout port over the entire perimeter of the rim portion 18. The outlet of the rim conduit 24 is therefore formed by only the single rim spout port 26. No ventilation port is formed in the rim conduit 24 for removing air accumulating in the rim conduit 24 during spouting from the rim spout port 26. Note that the rim spout port 26 is formed in the front side region F1 of the bowl portion 20, and the rim conduit 24 extends from the rear side region R1 to the front side region F1. The total length of the rim conduit 24 increases, therefore the amount of air accumulating in the rim conduit 24 increases more than when the rim conduit 24 is short. On the other hand the rim conduit 24 does not extend from the rear side region R1 to the front edge of the bowl portion 20. Therefore the volume of the rim conduit 24 can be reduced compared to the case in which the rim conduit 24 extends through the interior of the rim portion 18 at the front edge of the bowl portion 20.

Furthermore, while in the flush toilet 1 of the present embodiment we discuss a form in which the rim conduit 24 and rim spout port 26 are disposed on the interior of the rim portion 18 on the right side of the bowl portion 20, the invention is not limited to such forms, and it would also be acceptable for the rim spout port 26 to be disposed on the rim portion 18 at the left side in the front side region F1 of the bowl portion 20, so as to spout water rearward. Any form is acceptable in which the rim conduit 24 and rim spout port 26 are disposed on one of the rim portions 18 on the left and right sides within front side region F1 of the bowl portion 20.

Also, in the flush toilet 1 of the present embodiment, the rim conduit 24 and rim spout port 26 are formed as a single unit on the toilet main body 2 by ceramic forming. For example, the rim conduit 24 and rim spout port 26 may be formed as separate bodies of resin or the like and attached to the toilet main body 2.

Next, as shown in FIG. 4, a rim conduit 24 comprises: an inlet portion 24*a* joined to a water conducting pipe 28, an outside portion 24*b* extending from this inlet portion 24*a* toward the front on the inside of a rim portion 18, a curved portion 24*c* curving inward from the downstream end of this outside portion 24*b*, and an inside portion 24*d* extending from this curved portion 24*c* rearward to the rim spout port 26. The rim conduit 24 forms a U-turning flow path made up of the outside portion 24*b*, the curved portion 24*c*, and the inside portion 24*d* inside the rim portion 18 on the right side of the front side region F1. The rim spout port 26 is formed on the downstream end of the inside portion 24*d*.

Figure 6:
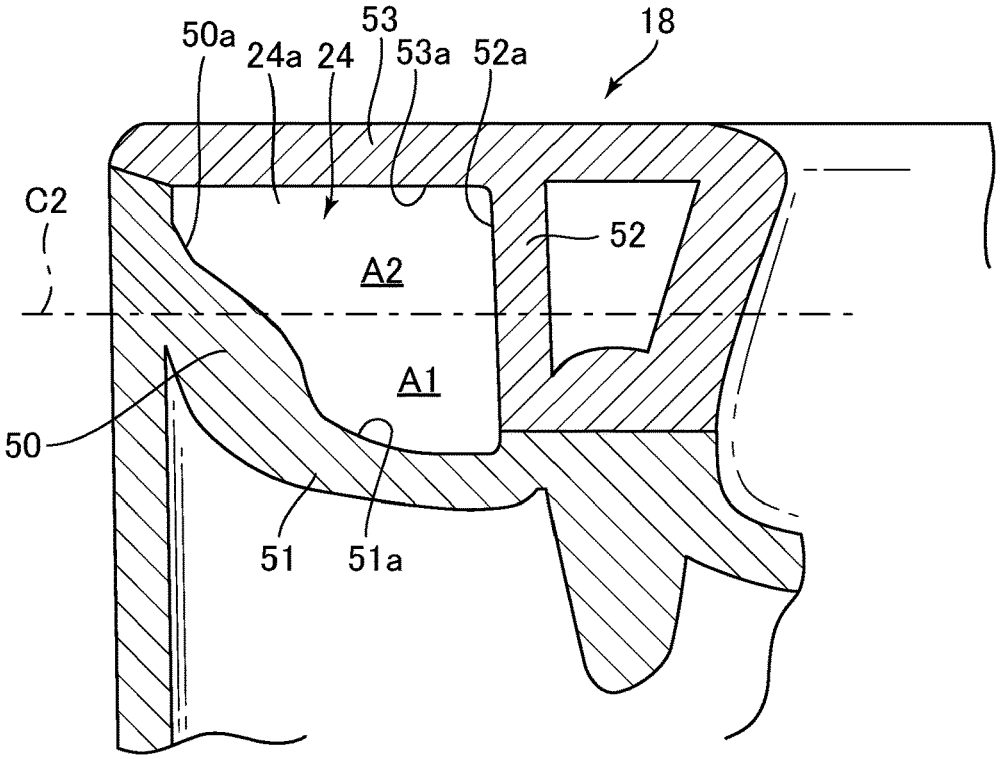
FIG. 6 is a cross section through line VI-VI in FIG. 4.
Figure 7:
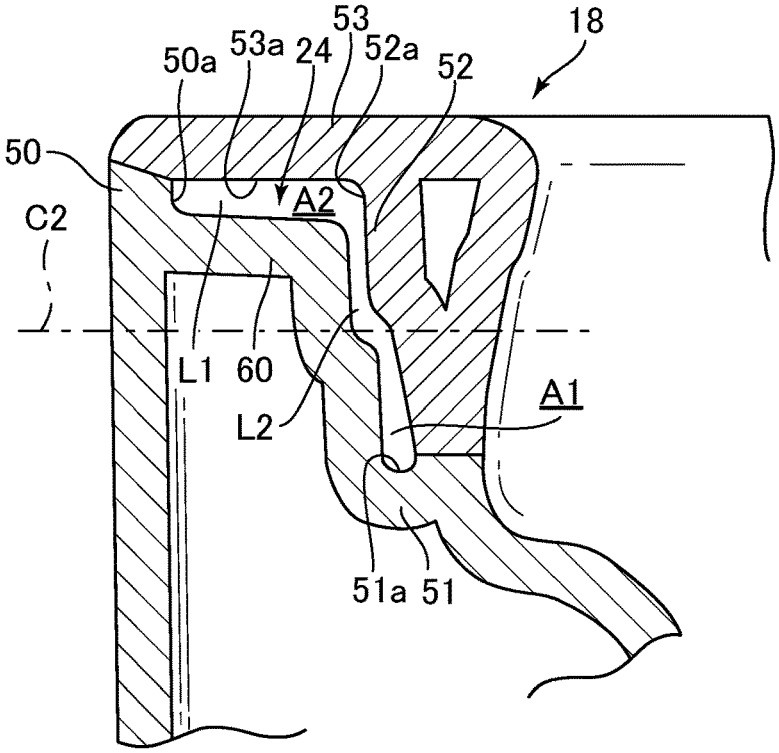
FIG. 7 is a cross section through line VII-VII in FIG. 4.
Figure 8:
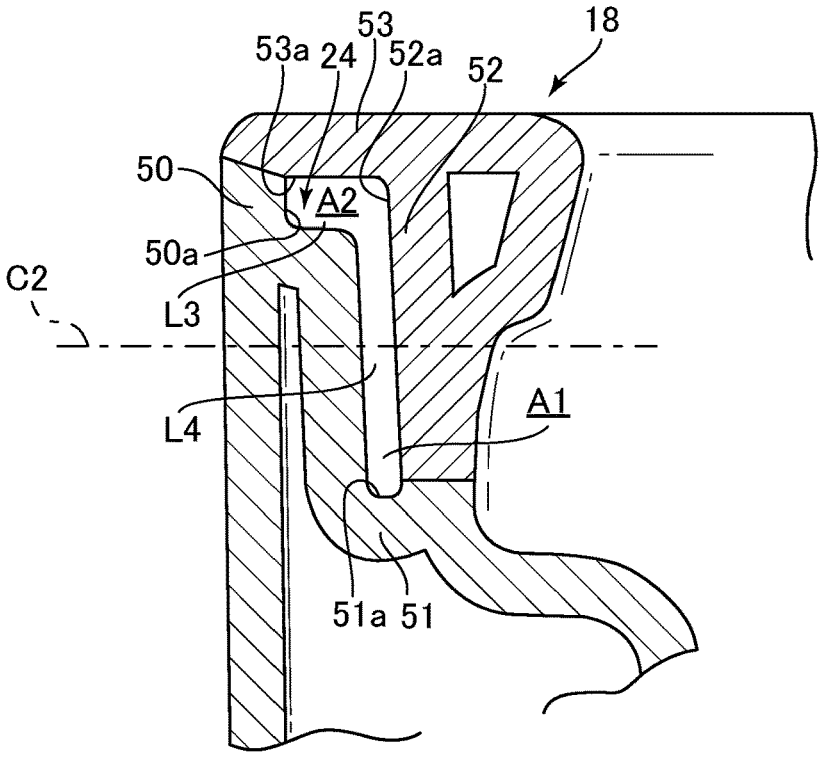
FIG. 8 is a cross section through line VIII-VIII in FIG. 4.
Figure 9:
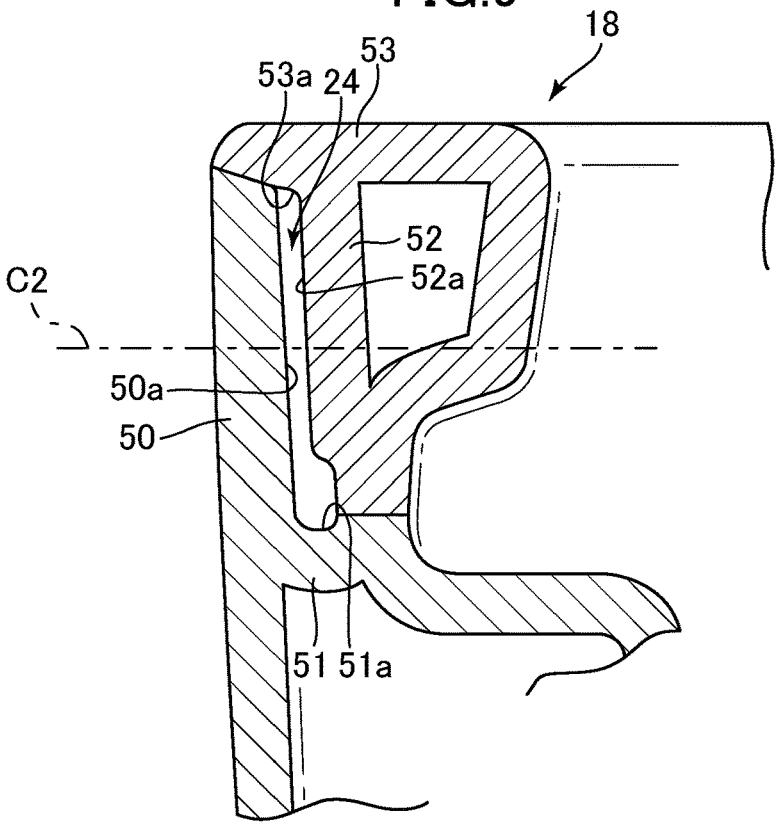
FIG. 9 is a cross section through line IX-IX in FIG. 4.
Figure 10:
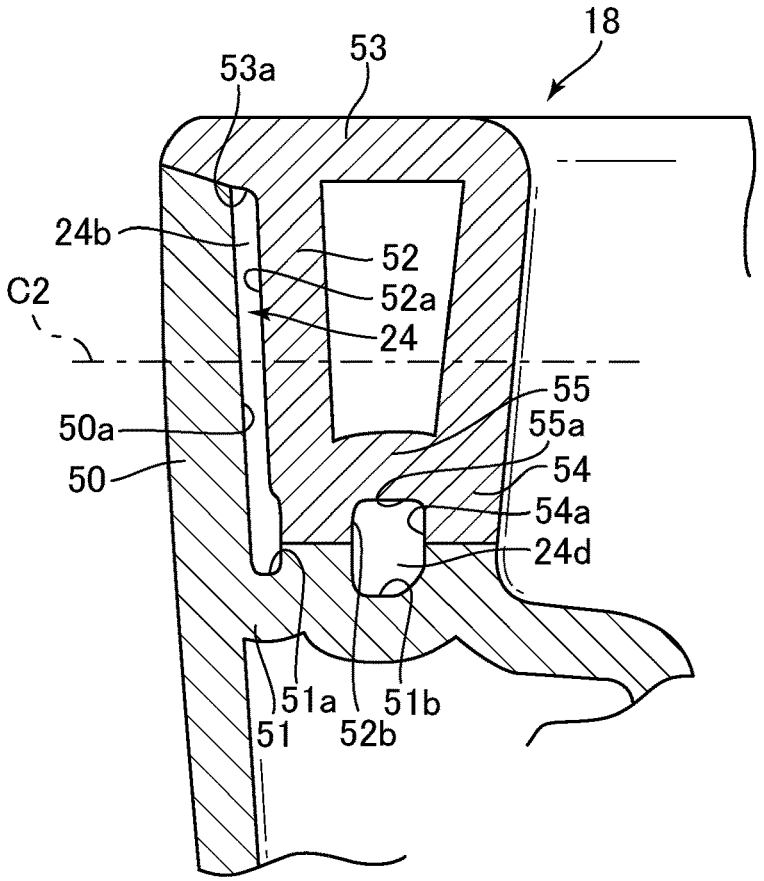
FIG. 10 is a cross section through line X-X in FIG. 4.
Figure 11:
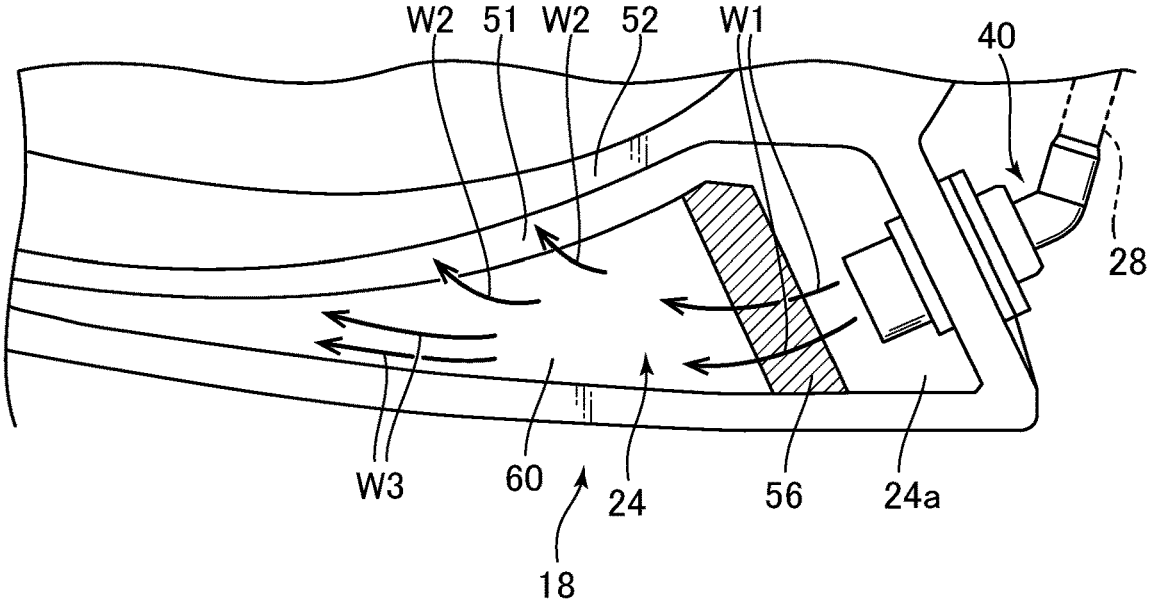
FIG. 11 is a plan view showing the internal structure around the inlet portion and the guide portion of a rim conduit in a flush toilet according to an embodiment of the invention.
Figure 12:
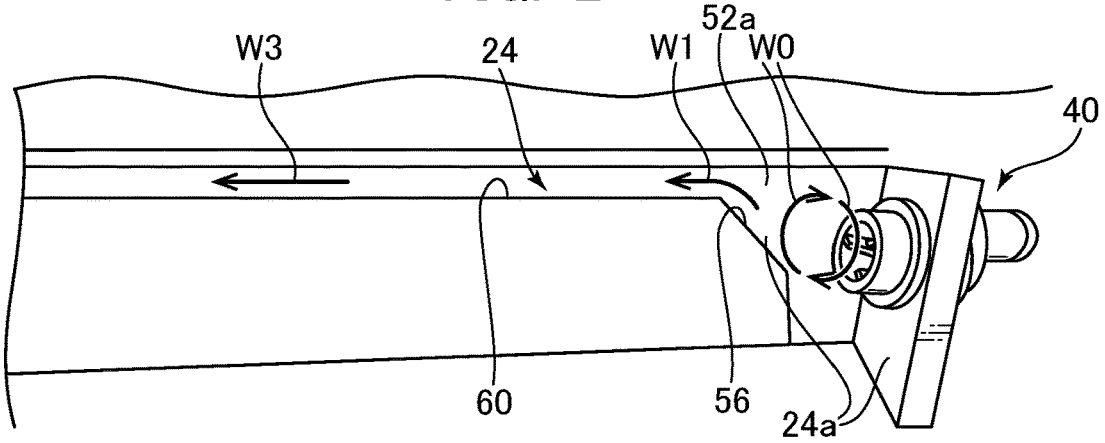
FIG. 12 is a side view showing the internal structure around the inlet portion and the guide portion of a rim conduit in a flush toilet according to an embodiment of the invention.
Figure 13:
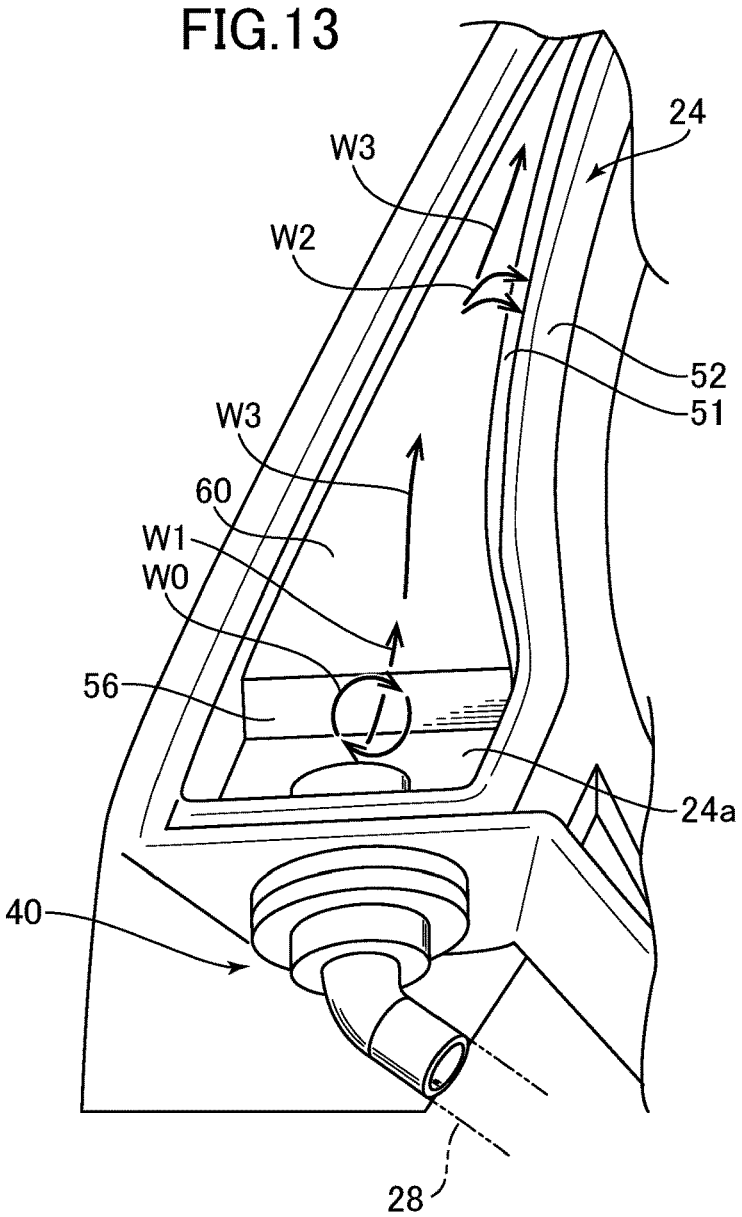
FIG. 13 is a perspective view showing the internal structure around the inlet portion and the guide portion of a rim conduit in a flush toilet according to an embodiment of the invention.

Below, in FIGS. 6-13, we discuss the shapes of the conduit in the rim conduit 24. FIG. 6 is a cross section through line VI-VI in FIG. 4. FIG. 7 is a cross section through line VII-VII in FIG. 4. FIG. 8 is a cross section through line VIII-VIII in FIG. 4. FIG. 9 is a cross section through line IX-IX in FIG. 4. FIG. 10 is a cross section through line X-X in FIG. 4. FIG. 11 is a plan view showing the internal structure around the inlet portion and the guide portion of a rim conduit in a flush toilet according to an embodiment of the invention. FIG. 12 is a side elevation showing the internal structure close to the inlet portion and the guide portion of a rim conduit in a flush toilet according to an embodiment of the invention. FIG. 13 is a perspective view showing the internal structure around the inlet portion and the guide portion of a rim conduit in a flush toilet according to an embodiment of the invention.

As shown in FIGS. 6-10, the rim conduit 24 is a conduit formed by the wall surface 50*a* of the outside wall portion 50 outside an internal conduit, a wall surface 51*a* on a lower wall portion 51 on the lower side of the internal conduit, a wall surface 52*a* on an inside wall portion 52 inside the internal conduit, and a wall surface 53*a* on an upper wall portion 53 on the upper side of the internal conduit.

As shown in FIG. 6, in the vicinity area of the inlet portion 24*a*, the rim conduit 24 has: a sectional shape formed by the wall surface 50*a* of the outside wall portion 50, which increases in slope more toward the inside of the bowl portion, the wall surface 51*a* of the lower wall portion 51 which slopes more gradually than the wall surface 50*a* toward the inside, the wall surface 52*a* of the inside wall portion 52 extending vertically, and the wall surface 53*a* of the upper wall portion 53 extending in the left-right direction.

As shown in FIG. 7, a horizontally-oriented, i.e. elongated in the left-right direction, long hole L1 is formed on the rim conduit 24 by the top edge portion of the wall surface 50*a* of the outside wall portion 50, the top edge portion of the wall surface 52*a* of the inside wall portion 52, and the wall surface 53*a* of the upper wall portion 53, in upper side of the center line C2 in the vertical direction of the rim portion 18. Such long hole L1 is formed on a stepped portion 60.

Also, a vertically-oriented, i.e. elongated in the up-down direction, long hole L2 is formed on the rim conduit 24 by the wall surface 50*a* of the outside wall portion 50, the wall surface 51*a* of the lower wall portion 51, and the wall surface 52*a* of the inside wall portion 52, in the lower side of the horizontally-oriented long hole L1, so as to continue from the horizontally-oriented long hole L1.

The rim conduit 24 is formed with a reverse L-shaped cross section in the vertical direction, combining the horizontally-oriented long hole L1 and the vertically-oriented long hole L2. Thus the rim conduit 24 has a hook-shaped cross sectional shape in the upper side of center line C2 of the rim portion 18, and a straight line cross sectional shape in the lower side of the center line C2. As shown in FIGS. 6-8, in the upstream portion 24*e* (see FIG. 4) on the side of the rear side region R1 of the rim conduit 24, the cross sectional area A1 in the vertical direction lower half of the rim portion 18 as seen in cross section is smaller than the upper half cross sectional area A2 thereof. The upstream portion 24*e* is a part on the rear side region R1 side of the rim conduit 24, from the inlet portion 24*a* of the rim conduit 24 up to the vicinity of the center line C1 thereof.

Note that in the present embodiment a cross sectional shape combining a vertically-oriented long hole and a horizontally-oriented long hole to form a reverse L shape is adopted, but the invention is not limited thereto, and various cross sectional shapes such as an inverse triangle shape may also be formed. In cases combining a vertically-oriented long hole and a horizontally-oriented long hole, various cross sectional shapes may be adopted, such as a T shape or a cross shape, in which the horizontally-oriented long hole is above the vertical center. Thus the rim conduit 24 may be given any desired shape in which the cross sectional area of the lower half portion in the vertical direction is smaller than the cross sectional area of the upper half portion thereof.

As shown in FIG. 8, a horizontally-oriented, i.e. elongated in the left-right direction, long hole L3 is formed on the rim conduit 24 by the top edge portion of the wall surface 50*a* of the outside wall portion 50, the top edge portion of the wall surface 52*a* of the inside wall portion 52, and the wall surface 53*a* of the upper wall portion 53, in upper side of the center line C2 in the vertical direction of the rim portion 18.

In the vicinity area of the center line C1 around the center in the front-back direction, the rim conduit 24 is formed to have a reverse L-shaped cross section combining a horizontally-oriented long hole L3 and a vertically-oriented long hole L4. Therefore the rim conduit 24 has a hook-shaped cross sectional shape in the upper side of the center line C2, and a straight line cross sectional shape in the lower side of the center line C2. In the vicinity of the center line C1, the cross sectional area of the bottom half portion A1 of the rim conduit 24 in the vertical direction of the rim portion 18 as seen in cross section is smaller than the cross sectional area A2 of the upper half portion thereof.

As shown in FIG. 9, between the intermediate portion and the downstream end of the outside portion 24*b* in the front side region F1, the rim conduit 24 forms a vertically-oriented long hole-shaped cross sectional shape by the wall surface 50*a* of the outside wall portion 50 as the long wall side of the rim conduit 24, the wall surface 51*a* of the lower wall portion 51 as the bottom surface of the short wall side of the rim conduit 24, the wall surface 52*a* of the inside wall portion 52 as the long wall side opposite the wall surface 50*a*, and the wall surface 53*a* of the upper wall portion 53 as the ceiling surface of the short wall side opposing the wall surface 51*a*.

As shown in FIG. 10, in the area close to the downstream end of the outside portion 24*b* in front side region F1, the rim conduit 24 is formed into a vertically-oriented long hole-shaped cross section shape by the wall surface 50*a* of the outside wall portion 50 as the long wall side of the rim conduit 24, the wall surface 51*a* of the lower wall portion 51 as the bottom surface of the short wall side of the rim conduit 24, the wall surface 52*a* of the inside wall portion 52 as the long wall side opposite the wall surface 50*a*, and the wall surface 53*a* of the upper wall portion 53 as the ceiling surface of the short wall side opposing the wall surface 51*a*.

In the rim conduit 24 an upper portion space into which flush water flows is formed on the downstream side in the immediate vicinity area of the inlet portion 24*a*, and the rim conduit 24 is formed by gradually shrinking so that the left-right width of the upper portion space narrows in the direction of the downstream side.

Also, as shown in FIG. 10, in the vicinity area of the upstream end of the inside portion 24*d* in the front side region F1, the rim conduit 24 is formed in a vertically-oriented short hole cross sectional shape by the wall surface 52*a* of the inside wall portion 52 forming a vertical wall, the wall surface 51*a* of the lower wall portion 51 forming a bottom wall in the lower side of the rim conduit 24, the wall surface 54*a* of the rim inner perimeter wall portion 54 forming a vertical wall opposite the wall surface 52*b*, and the wall surface 55*a* of the upper wall portion 55 forming a ceiling surface facing the wall surface 51*b*.

Next, as shown in FIG. 5, the height of the wall surface 53*a* of the internal conduit from the inlet portion 24*a* to the outside portion 24*b* of the rim conduit 24 is relatively high. The height of the wall surface 53*a* of the internal conduit up to the outside portion 24*b* is higher than that of the top end 26*a* of the rim spout port 26. In the curved portion 24*c*, the height of the internal conduit is reduced from the height of the wall surface 53*a* of the outside portion 24*b* down to the height of the wall surface 55*a* of the inside portion 24*d*. The height of the internal conduit from the inside portion 24*d* to the rim spout port 26 is relatively low, and is essentially constant. Thus the rim conduit 24 has a water conduit with a height higher than the height of the opening of the rim spout port 26. The height from the wall surface 51*a* to the wall surface 53*a* of the rim conduit 24 is higher than the height from the wall surface 51*b* to the wall surface 55*a* of the rim spout port 26. The rim spout port 26 is formed so that the top end 26*a* of the rim spout port 26 is positioned in the lower half portion in the lower side of the center line C2 of the rim portion 18. The rim spout port 26 is formed to have a narrow diameter relative to the rim conduit 24.

As shown in FIGS. 11-13, a guide portion 56 is disposed on the inlet portion 24*a* of the rim conduit 24. The guide portion 56 forms a guide surface defined between the inlet portion 24*a* and the upper space in the rim conduit 24. The guide portion 56 is formed on a line extending in the direction in which water is spouted from a rim nozzle 40. The guide portion 56 forms a sloped surface sloping diagonally upward relative to the direction in which water is spouted from the rim nozzle 40. The guide portion 56 is disposed so that flush water spouted from the rim nozzle 40 collides with it, and the guide portion 56 guides the collided flush water into an upper space in the upper side of the interior of the rim conduit 24.

Figure 14:
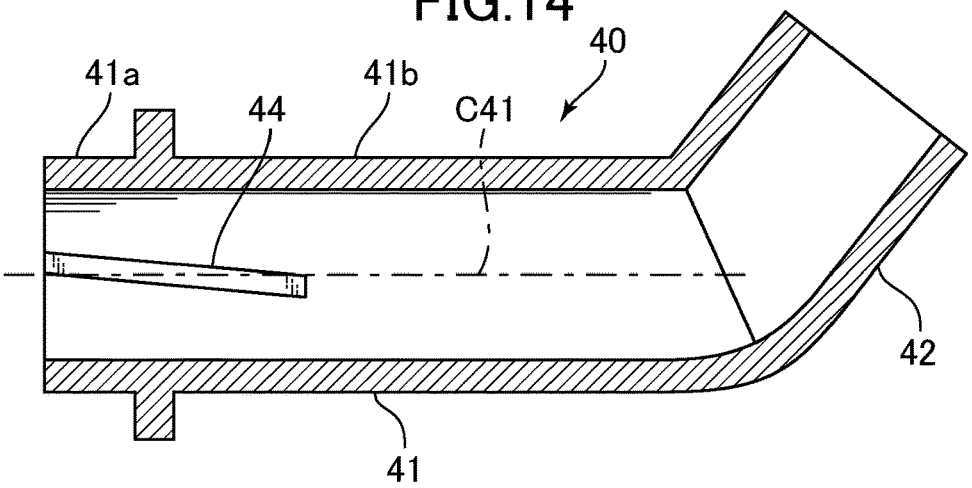
FIG. 14 is a center cross section of a rim nozzle of a flush toilet according to an embodiment of the invention.
Figure 15:
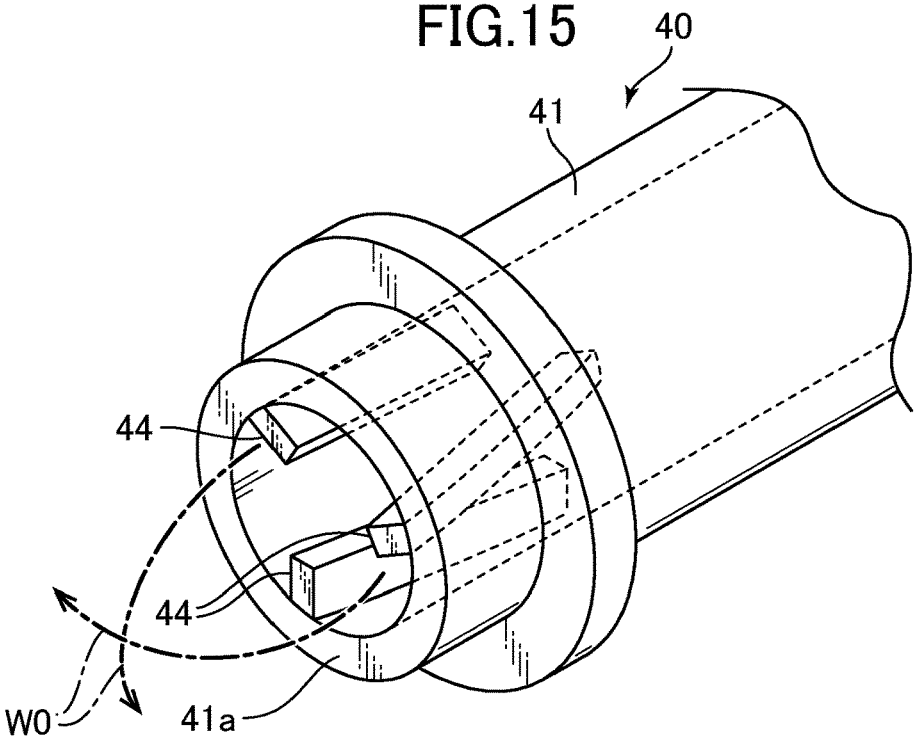
FIG. 15 is an outline perspective view of a rim nozzle of a flush toilet according to an embodiment of the invention.
Figure 16:
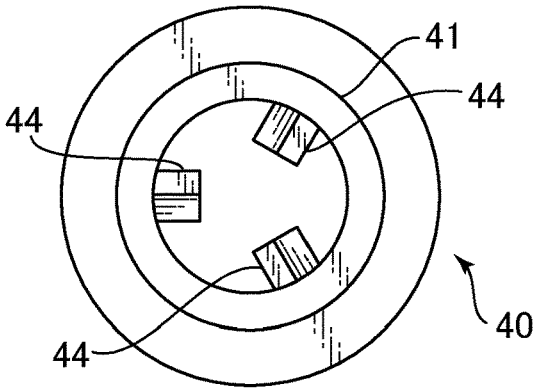
FIG. 16 is a front elevation seen from the front end side of a rim nozzle of a flush toilet according to an embodiment of the invention.

Next, referring to FIGS. 14-16, we discuss in detail the rim nozzle 40 in a flush toilet 1 according to an embodiment of the invention.

FIG. 14 is a center cross section of a rim nozzle of a flush toilet according to an embodiment of the invention. FIG. 15 is an outline perspective view of a rim nozzle of a flush toilet according to an embodiment of the invention. FIG. 16 is a front elevation seen from the front end side of a rim nozzle of a flush toilet according to an embodiment of the invention.

As shown in FIGS. 3 and 4, the rim nozzle 40, which is a nozzle in the present embodiment, is disposed on the downstream end of the water conducting pipe 28. The rim nozzle 40 is attached to the inlet portion 24*a* of the rim conduit 24. The rim nozzle 40 spouts and supplies flush water supplied from the water conducting pipe 28 into the rim conduit 24.

As shown in FIGS. 14-16, the rim nozzle 40 comprises a nozzle main body 41, a connecting portion 42, and ribs 44 projecting inward in the nozzle main body 41. The nozzle main body 41 is formed, for example, in a cylindrical shape. The nozzle main body 41 forms a water passageway for flush water in the rim nozzle 40. The connecting portion 42 connects the rim nozzle 40 to the water conducting pipe 28.

The tip portion 41*a* of the nozzle main body 41 is disposed to project slightly into the rim conduit 24 when attached to the inlet portion 24*a* of the rim conduit 24.

The ribs 44, which are a stirring portion for agitating flush water supplied into the rim conduit 24, are formed to project into the water passageway in the nozzle main body 41. The ribs 44 form a stir-function portion. The ribs 44 are disposed to extend from the tip portion 41*a* up to the middle portion 41*b* of the nozzle main body 41. The ribs 44 may also be disposed on only the tip portion 41*a* or the middle portion 41*b*. The ribs 44 also function as a stationary drive portion (rotating flow generator), imparting to the flush water a rotary force centered on the axis which is the flow direction of the flush water. The ribs 44 are disposed on the inlet portion 24*a* of the rim conduit 24.

The ribs 44 form thin plate-shaped blades, and are disposed in a spiral shape along the inside circumferential surface of the nozzle main body 41. The blades of he ribs 44 are oriented so as to rotate about an axis centered on center line C41. The ribs 44 impart a rightward rotary force to the flow of flush water, centered on the center line C41. Three ribs 44 (three rows) are disposed inside the nozzle main body 41, but it is also acceptable to provide one, two, or four or more thereof. Flush water is thus spouted from the nozzle main body 41 so as to circulate, agitating flush water inside the rim conduit 24, so that air accumulated in the upper portion within the rim conduit 24 is stirred by agitated flush water.

Next, referring to FIGS. 2, 3, and 11-13, we explain the operation (action) of a flush toilet according to an embodiment of the invention.

When, for example, a user presses a operating button for full flush after use, a signal is transmitted from this operating button (not shown) to a controller 13, starting a full flushing operation to flush the flush toilet 1. When a user operates the operating button (not shown), the controller 13 supplies flush water from a supply source such as a municipal utility to the rim nozzle 40 through the water conducting pipe 28. In nozzle main body 41 of the rim nozzle 40, rotational force centered on the center line C41 is imparted by the ribs 44 to the flush water. As shown by the arrow W0 (see FIGS. 12 and 15), flush water is spouted into the rim conduit 24 as it is rotated out of the rim nozzle 40. Thus flush water supplied into the rim conduit 24 by the ribs 44 is agitated by the ribs 44 and dispersed within the rim conduit 24, so that air accumulating in the upper portion within the rim conduit 24 is stirred by the agitated flush water. The flush water forms an agitated flow which circulates even in the inlet portion 24*a* and in the upper space above the stepped portion 60. The flow of flush water in the upper portion within the rim conduit 24 results in a fine breakdown of air in the rim conduit 24 and mixing of the air into the flush water, so that air with suppressing forming agglomeration of the air can be spouted from the rim spout port 26 together with flush water. Thus anomalous sounds such as the sound of air explosions or air mixing when flush water is spouted from the rim spout port 26 together with air accumulated in the upper portion within the rim conduit can be further suppressed, and silence of the flush toilet is improved.

As shown in FIGS. 11-13, flush water spouted from the rim nozzle 40 into the rim conduit 24 collides with the guide portion 56 and, as indicated by arrow W1, rises toward the upper portion space within the rim conduit 24. Because of the guide portion 56, flush water flows more easily into the upper portion space above the top side of the center line C2 within the rim conduit 24, and preferably into the upper portion space on the stepped portion 60. Air accumulating in the upper portion within the rim conduit 24 is stirred by agitated flush water.

As shown by the arrow W2, while flush water which has flowed into the upper portion space within the rim conduit 24 is flowing over the stepped portion 60 toward the downstream side, stirring the air accumulated in the upper portion of the rim conduit 24, the flush water turns into a dropping flow, sequentially dropping from the upper portion space in the rim conduit 24, which the width of the upper portion space gradually narrows in the left-right direction, and flowing onto the lower wall portion 51 of the rim conduit 24.

In the upstream portion 24*e* of the rim conduit 24 (see FIG. 4), because the cross sectional area A1 of the bottom half portion thereof is smaller than the cross sectional area A2 of the top half portion, as shown by the arrow W3, flush water can more easily flow on the stepped portion 60 in the upper portion space of the rim conduit 24. Air accumulated at the upper portion within the rim conduit 24 can thus be more easily stirred by the agitated flush water.

Also, in the upstream portion 24*e* of the rim conduit 24, the cross sectional shape of the rim conduit 24 in the vertical direction is formed by a combination of a vertically-oriented long hole L2 and a horizontally-oriented long hole L1. Thus, as shown by arrow W3, flush water can more easily flow on the stepped portion 60 in the upper portion space of the rim conduit 24.

Increasingly more flush water flows down within the vertically-oriented long hole as the flush water flows toward the downstream end of the outside portion 24*b*. Before the flush water reaches the curved portion 24*c*, air accumulated in the upper portion within the rim conduit 24 is stirred into the flush water. This makes it difficult for air clumps to form in the curved portion 24*c*, therefore anomalous sounds caused by air can be suppressed.

The flow of flush water changes to a rearward direction in the curved portion 24*c*, then passes through the inside portion 24*d* to be jetted toward the rear from the rim spout port 26. Even if the rim spout port 26 is disposed in the front side region F1 of the bowl portion 20 in order to improve aesthetics or improve flush water circulation characteristics, air is stirred into the flush water, and anomalous sounds caused by air can be suppressed, and silence characteristics of the flush toilet can be improved. Flush water spouted from the rim spout port 26 forms a downward flowing circulating flow as the flush water circulates within the bowl portion 20, so that the inside wall surface of the bowl portion 20 is flushed.

Jet spouting is then started. First, the controller 13 sends a signal to the pressurizing pump 36 to start. Flush water stored in a reservoir tank 34 is pressurized by a pressurizing pump 36 and jetted from a jet spout portion 32 opened at the lower portion of the bowl portion 20. Flush water jetted from the jet spout portion 32 flows into the discharge trap pipe 22, and a siphon phenomenon is induced when the discharge trap pipe 22 is filled with water. This siphon phenomenon causes accumulated water and waste in the bowl portion 20 to be suctioned into the discharge trap pipe 22 and discharged from a discharge pipe (not shown) on the downstream side. After a certain time has elapsed following supply of flush water to the toilet main body 2, the controller 13 ends spouting of water from the rim spout port 26, stops operation of the pressurizing pump 36, and ends the sequence of flush operations.

Figure 17:
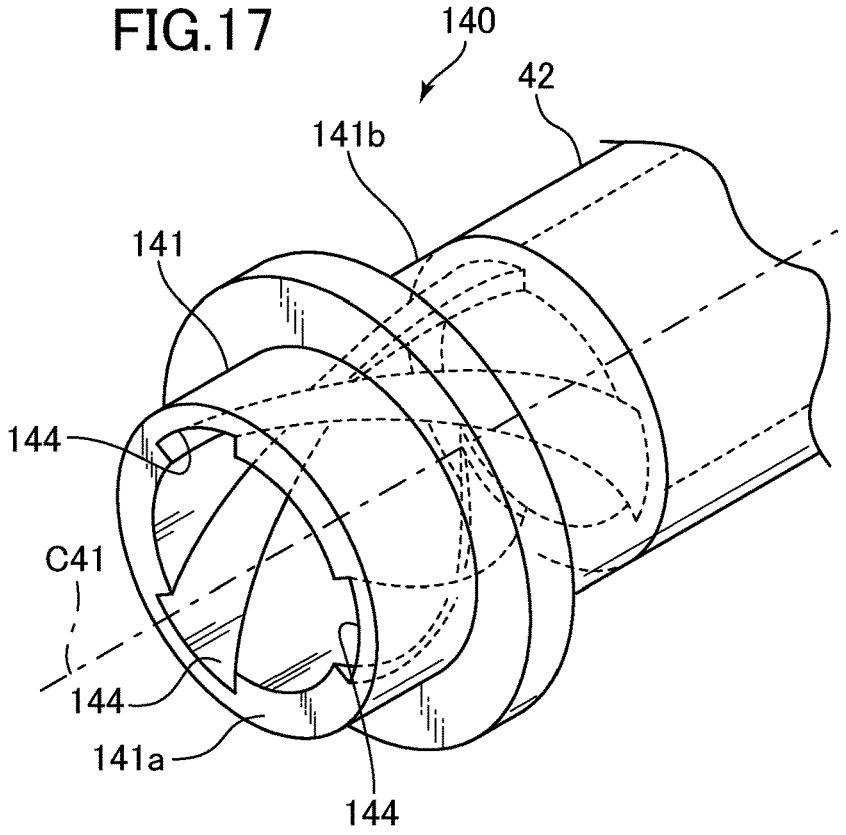
FIG. 17 is a perspective view showing a first variant example of a rim nozzle of a flush toilet according to an embodiment of the invention.

Next, referring to FIG. 17, we discuss a first variant example of the rim nozzle 40 in a flush toilet 1 according to an embodiment of the invention.

FIG. 17 is a perspective view showing a first variant example of a rim nozzle of a flush toilet according to an embodiment of the invention.

The same reference numerals are assigned to those parts in the rim nozzle 140 of the flush toilet 1 according to the embodiment of the invention shown in FIG. 17 which are the same as parts of the rim nozzle 40 in flush toilet 1 according to the embodiment of the invention shown in FIG. 14, and an explanation of those is here omitted.

The rim nozzle 140 is disposed on the downstream end of the water conducting pipe 28, and is attached to the inlet portion 24*a* of the rim conduit 24. The rim nozzle 140 comprises a nozzle main body 141, a connecting portion 42, and channel portions 144 indented into the outer side from the inside circumferential surface of the nozzle main body 141. The nozzle main body 141 is formed, for example, in a cylindrical shape. The nozzle main body 141 forms a water passageway for flush water in the rim nozzle 140.

The tip portion 141*a* of the nozzle main body 141 is disposed to project slightly into the rim conduit 24 when attached to the inlet portion 24*a* of the rim conduit 24.

The channel portions 144, which are stirring portions for agitating flush water supplied into the rim conduit 24, are formed along the inside circumferential surface within the nozzle main body 141. The channel portions 144 form a stir-function portion. The channel portions 144 are disposed to extend from the tip portion 141*a* up to the middle portion 141*b* of the nozzle main body 141. The channel portions 144 may also be disposed on only the tip portion 141*a* or the middle portion 141*b*. The channel portions 144 also function as a stationary drive portion, and impart to the flush water flow a rotational force being formed about an axis in the flow direction of flush water, being the direction in which, for example, the center line C41 extends. The channel portions 144 are disposed on the inlet portion 24*a* of the rim conduit 24.

The channel portions 144 form channel portions extending in the longitudinal direction, and are disposed in spiral shape along the inside circumferential surface of the nozzle main body 141. Each channel portion 144 forms a depression having a width being approximately sixth part of the inside circumference of the nozzle main body 141. The channel portions 144 are oriented so as to rotate about an axis centered on center line C41. The channel portions 144 impart a leftward rotary force to the flow of flush water, centered on the center line C41. Three channel portions 144 (three rows) are disposed on the inside circumference in the nozzle main body 141, but it is also acceptable to provide one, two, or four or more thereof. Flush water is thus spouted from the nozzle main body 141 so as to circulate, agitating flush water inside the rim conduit 24, so that air accumulated in the upper portion within the rim conduit 24 is stirred by agitated flush water. Thus the occurrence of anomalous sounds caused by air accumulated in the upper portion within the rim conduit 24 can be suppressed when flush water is spouted from the rim spout port 26, and silence of the flush toilet 1 can be further improved.

Figure 18:
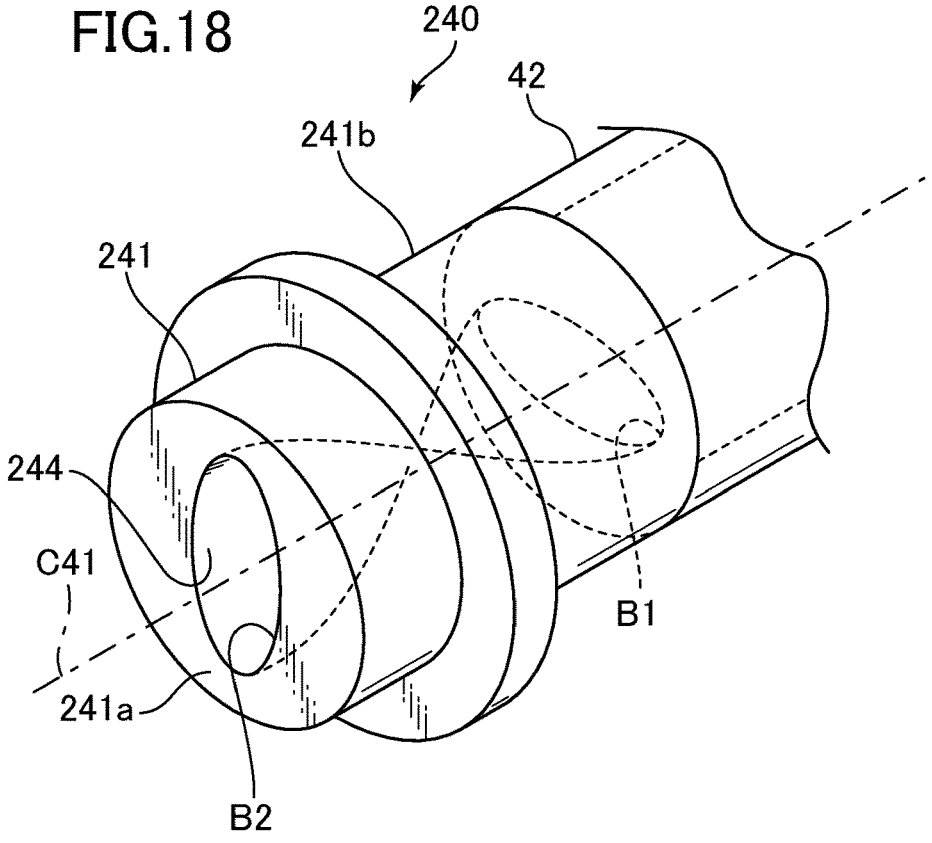
FIG. 18 is a perspective view showing a second variant example of a rim nozzle of a flush toilet according to an embodiment of the invention.

Next, referring to FIG. 18, we discuss a second variant example of the rim nozzle 40 in a flush toilet 1 according to an embodiment of the invention.

FIG. 18 is a perspective view showing a second variant example of a rim nozzle of a flush toilet according to an embodiment of the invention. In FIG. 18, the outside shape of the flow path within the nozzle main body 241 is shown by a dotted line.

The same reference numerals are assigned to those parts in the rim nozzle 240 of the flush toilet 1 according to the embodiment of the invention shown in FIG. 18 which are the same as parts of the rim nozzle 40 in flush toilet 1 according to the embodiment of the invention shown in FIG. 14, and an explanation thereof is here omitted.

The rim nozzle 240 is disposed on the downstream end of the water conducting pipe 28. The rim nozzle 240 is attached to the inlet portion 24*a* of the rim conduit 24. The rim nozzle 240 spouts and supplies flush water supplied from the water conducting pipe 28 into the rim conduit 24.

The rim nozzle 240 comprises a nozzle main body 241, a connecting portion 42, and a change flow path 244 formed on the inside of the nozzle main body 241. The nozzle main body 241 is formed, for example, in a cylindrical shape. The nozzle main body 241 forms a water passageway for flush water in the rim nozzle 240.

The tip portion 241*a* of the nozzle main body 241 is disposed to project slightly into the rim conduit 24 when attached to the inlet portion 24*a* of the rim conduit 24.

The change flow path 244, which is a stirring portion for agitating flush water supplied into the rim conduit 24, causes the direction of the water passageway in the nozzle main body 241 to change. The change flow path 244 forms a stir-function portion. In the middle portion 241*b* of the nozzle main body 241, the change flow path 244 forms a flow path B1 with an elliptical outer shape having a long diameter in the left-right direction and a short diameter in the up-down direction, as seen in cross section. In addition, at the tip portion 241*a* of the nozzle main body 241, the change flow path 244 forms a flow path B2 with an elliptical outer shape having a short diameter in the left-right direction and a long diameter in the up-down direction, as seen in cross section. Also, from the middle portion 241*b* to the tip portion 241*a* of the nozzle main body 241, the elliptical flow path B1, with a long diameter in the left-right direction, is gradually rotated so that the angle of the ellipse gradually changes, becoming an elliptical flow path B2 with a long diameter in the up-down direction at the tip portion 241*a*. In this manner, the nozzle main body 241 is formed so that the elliptical cross sectional surface thereof rotates about an axis centered on the center line C41 as the elliptical cross sectional surface advances to the downstream side.

It is also possible that from the middle portion 241*b* to the tip portion 241*a* of the nozzle main body 241 of the change flow path 244, the elliptical flow path B1 with a long diameter in the left-right direction gradually changes; the ratio between the long diameter and short diameter is gradually changed, and the long diameter and short diameter are exchanged, becoming a flow path B2 with a long diameter in the up-down direction at the tip portion 241*a*.

The change flow path 244 is disposed to extend from the tip portion 241*a* up to the middle portion 241*b* of the nozzle main body 241. The change flow path 244 may also be disposed only on the tip portion 241*a* or on the middle portion 241*b*. The change flow path 244 also functions as a stationary drive portion, imparting to the flush water a rotary force centered on the axis in the flow direction of flush water. The change flow path 244 is disposed on the inlet portion 24*a* of the rim conduit 24.

The change flow path 244 forms a flow path such that the elliptical cross section of the water passageway gradually turns toward the downstream side. The change flow path 244 forms a flow path which rotates about an axis centered on center line C41. The change flow path 244 imparts a rightward rotary force to the flow of flush water, centered on the center line C41. Flush water is thus spouted from the nozzle main body 241 so as to circulate, agitating flush water inside the rim conduit 24 so that air accumulated in the upper portion within the rim conduit 24 is stirred by agitated flush water. Thus the occurrence of anomalous sounds caused by air accumulated in the upper portion within the rim conduit 24 can be suppressed when flush water is spouted from the rim spout port 26, and silence of the flush toilet 1 can be further improved.

Next we explain the operation of a flush toilet 1 according to an embodiment of the invention.

First, according to a flush toilet 1 according to an embodiment of the invention, flush water supplied into the rim conduit 24 is agitated by a stirring portion (ribs 44, channel portions 144, or change flow path 244), and air accumulated in the upper portion within the rim conduit 24 can be stirred by the agitated flush water. Air in the rim conduit 24 is thus finely divided within the rim conduit 24 and spouted from the rim spout port 26 together with flush water. Thus by using the present invention, the occurrence of anomalous sounds can be suppressed when flush water is spouted from the rim spout port 26 together with air accumulated in the upper portion within the rim conduit 24, and silence of the flush toilet 1 can be improved.

Next, according to a flush toilet 1 according to an embodiment of the invention, a rotational force being formed about an axis in the flow direction of flush water supplied into the rim conduit 24 is imparted to a flow of flush water by a stationary drive portion (ribs 44, channel portions 144, or change flow path 244). The flow of flush water is thus agitated, and air accumulated at the upper portion within the rim conduit 24 can be stirred by the agitated flush water.

Also, according to a flush toilet 1 according to an embodiment of the invention, the stirring portion is disposed on the inlet portion 24*a* of the rim conduit 24. Thus flush water supplied into the rim conduit 24 is agitated from the inlet portion 24*a* of the rim conduit 24, and air accumulated in the upper portion within the rim conduit 24 can be efficiently stirred by agitated flush water.

Furthermore, according to a flush toilet 1 according to an embodiment of the invention, in a rim conduit 24 in which anomalous sounds caused by air accumulated in the upper portion within the rim conduit 24 can easily occur, such as the rim conduit 24 having a conduit with a height higher than the height of the opening of the rim spout port 26, flush water supplied into the rim conduit 24 is agitated by the stirring portion. Air accumulated at the upper portion within the rim conduit 24 can thus be stirred by the agitated flush water.

In addition, according to a flush toilet 1 according to an embodiment of the invention, in a rim conduit 24 in which anomalous sounds caused by air accumulated in the upper portion within the rim conduit 24 can easily occur, such as the rim conduit 24 extending from the rear side region R1 of the bowl portion 20 to the rim spout port 26 formed in the front side region F1 thereof, flush water supplied into the rim conduit 24 is agitated by the stirring portion. Air accumulated at the upper portion within the rim conduit 24 can thus be stirred by the agitated flush water.

Moreover, according to a flush toilet 1 according to an embodiment of the invention, flush water supplied into the rim conduit 24 is agitated by the ribs 44 projecting into the water passageway of the rim nozzle 40 at the tip portion of the rim nozzle 40, and air accumulated at the upper portion within the rim conduit 24 can be stirred by the agitated flush water.

In addition, according to a flush toilet 1 according to an embodiment of the invention, the rim conduit 24 comprises an inside portion 24*d* extending inside the rim portion 18 from the outside portion 24*b* extending frontward, through the curved portion 24*c*, and toward the rear, and extends up to the rim spout port 26, which spouts flush water rearward. Therefore the volume of the rim conduit 24 can be reduced compared to the case in which the rim conduit 24 extends through the interior of the rim portion at the front end of the bowl portion 20. Thus the amount of air accumulating in the upper portion inside the rim conduit 24 can be reduced, and the occurrence of air-induced anomalous sounds can be still further suppressed.

Also, according to a flush toilet 1 according to an embodiment of the invention, flush water supplied into the rim conduit 24 can more easily flow into the upper portion within the rim conduit 24, and air accumulated in the upper portion within the rim conduit 24 can be more easily stirred by agitated flush water. Air in the rim conduit 24 is thus finely divided within the rim conduit 24 and spouted from the rim spout port 26 together with flush water. Thus the occurrence of anomalous sounds caused by air accumulated in the upper portion within the rim conduit 24 can be suppressed when flush water is spouted from the rim spout port 26 together with air accumulated in the upper portion within the rim conduit 24, and silence of the flush toilet 1 can be further improved.

Also, according to a flush toilet 1 according to an embodiment of the invention, flush water supplied into the rim conduit 24 by the guide portion 56 can be made to more easily flow into the upper portion within the rim conduit 24, and air accumulated in the upper portion within the rim conduit 24 can be more easily stirred by agitated flush water. Thus the occurrence of anomalous sounds caused by air accumulated in the upper portion within the rim conduit 24 can be suppressed when flush water is spouted from the rim spout port 26 together with air accumulated in the upper portion within the rim conduit 24, and silence of the flush toilet 1 can be further improved.

Furthermore, according to a flush toilet 1 according to an embodiment of the invention, vertically-oriented long holes extend to the top half portion of the rim conduit 24. Therefore a rim conduit 24 can be easily formed in which the cross sectional area A1 of the bottom half portion of the rim conduit 24 is smaller than the cross sectional area A2 of the top half portion thereof. Hence flush water supplied into the rim conduit 24 can be made to more easily flow into the upper portion within the rim conduit 24, and air accumulated in the upper portion within the rim conduit 24 can be more easily stirred by agitated flush water.

What is claimed is:

1. A flush toilet flushed by flush water supplied from a flush water supply source to discharge waste, comprising:

a bowl portion comprising a bowl-shaped waste receiving surface and a rim portion formed on a top edge of the waste receiving surface;

a rim spout port configured to spout flush water from the rim portion onto the bowl portion;

a rim conduit disposed within the rim portion extending from a rear side region of the bowl portion to the rim spout port; and a stirring portion configured to agitate flush water which is supplied into the rim conduit from the flush water supply source, wherein the stirring portion comprises a stationary drive portion configured to impart a rotational force to a flow of flush water, the rotational force being formed about an axis in a flow direction of flush water, and wherein the stirring portion is disposed on an inlet portion of the rim conduit.

2. The flush toilet of claim 1, wherein the rim conduit has a conduit with a height higher than the height of the opening of the rim spout port.

3. The flush toilet of claim 1, wherein the rim spout port is formed on the rim portion in the front side region of the bowl portion.

4. The flush toilet of claim 1, comprising a nozzle for supplying flush water into the rim conduit, wherein the stirring portion is a rib projecting into a conduit of the nozzle at the tip portion of the nozzle.

5. The flush toilet of claim 1, wherein the rim conduit comprises:

an outside portion extending in the interior of the rim portion toward a front;

a curved portion curving to an inside from the downstream end of the outside portion;

and an inside portion extending from the curved portion toward a rear;

wherein the rim spout port is formed at the downstream end of the inside portion, and spouts flush water toward the rear.

6. The flush toilet of claim 1, wherein the rim conduit is formed so that in an upstream portion of the rim conduit, a cross sectional area of a lower half of the upstream portion is smaller than the cross sectional area of an upper half of the upstream portion.

7. The flush toilet of claim 1, wherein the rim conduit has a guide portion for guiding upwardly flush water supplied into the rim conduit.

8. The flush toilet of claim 1, wherein the rim conduit has a cross sectional shape in the vertical direction, the cross sectional shape is formed by a combination of a vertically-oriented long hole and a horizontally-oriented long hole.

* * * * *